United States Patent [19]

Bianchi

[11] 4,212,418

[45] Jul. 15, 1980

[54] SHOULDER HOLSTER WITH IMPROVED SHOULDER STRAP ARRANGEMENT

[76] Inventor: John E. Bianchi, 1601 Wilt Rd., Fallbrook, Calif. 92028

[21] Appl. No.: 853,589

[22] Filed: Nov. 21, 1977

[51] Int. Cl.[2] ..... F41B 13/04

[52] U.S. Cl. ..... 224/206; 224/911; 24/206 A

[58] Field of Search ..... 224/2 B, 2 C, 2 R, 1 R, 224/5 R, 5 P, 5 BC, 5 A, 5 H, 5 U, 6, 8 R; 2/338, 311, 300, 339; 24/200, 16 R, 17 R, 206 R, 206 A, 16 PB, 17 A, 34, 68 F, 115 H, 11.71, 129

[56] References Cited

U.S. PATENT DOCUMENTS

| | | | |
|---|---|---|---|
| 2,076,925 | 4/1937 | Steinberg | 224/5 BC |
| 2,579,782 | 12/1951 | Booth | 224/2 B |
| 2,987,229 | 6/1961 | Leclerc | 224/2 C |
| 3,587,580 | 6/1971 | Jones, Sr. | 24/206A |
| 3,799,413 | 3/1974 | McBain | 224/5 D |

*Primary Examiner*—Kenneth W. Noland
*Attorney, Agent, or Firm*—John E. Wagner

[57] ABSTRACT

A shoulder holster employing an over-the-shoulder strap which includes a broadened support area and a narrower holster engaging portion at each end. The holster body is made up of a single or multiple piece assembly defining a holster pocket and including elongated upwardly extending support arms at an acute angle to provide two directional supports to the holster body. The upwardly extending portions of the holster include a plurality of transverse slots having a width approximating the width of the elongated support portion of the shoulder strap. The elongated portions of the shoulder strap are interleaved or woven in and out of the slots of the upwardly extending support portions of the holster. The end of the shoulder straps extend beyond the last transverse slot in the holster whereby a precise adjustment of the elevation of the holster, both front and rear, may be accomplished by the position of engagement of the shoulder strap with the multiple slots. Continuous adjustment is available but the surface friction between the shoulder strap and the support portion of the holster along with frictional engagement between the shoulder strap in the slot provides a firm, unmoving support for the holster when it is once adjusted. The shoulder strap and holster support portion provide no more than two thicknesses of leather for improved concealment as compared with the prior art.

4 Claims, 8 Drawing Figures

SHOULDER HOLSTER WITH IMPROVED SHOULDER STRAP ARRANGEMENT

BACKGROUND OF THE INVENTION

For many years the shoulder strap designed for larger weapons such as large frame revolvers or automatics have traditionally involved a holster body with a pair of upwardly extending portions, one integral with or stitched to the front of the holster and the other with the rear of the holster. These support portions extend angularly such that one will extend partially around the chest of the wearer, and the other extends partially around his back. The over the shoulder support strap extends downward in overlying or relationship to its ends with the support portions of the holster. The two have typically been held together by lacing similar to a conventional shoelace, through mating holes, or in certain cases, both the shoulder strap and the support portion of the holster have included matching transverse slots, spaced, for example, one inch apart. The shoulder strap and the holster in such case are joined together by a flat leather strap which is interwoven through the matching slots in the two parts. This has provided at least three thicknesses of leather throughout the adjustment region which fall directly over the breast pocket of the wearer, or over the shoulder blade at the rear. Because of the interleaving woven strap, which assumes a direction while passing through the aligned slots of approximately normal to the surface of the strap and shoulder extension, the thickness of the mating region between the shoulder strap and the holster support is at least four thicknesses of leather. This sometimes results in a visible bulge, which is highly undesirable.

Moreover, the laced and the interwoven strap arrangement of the prior art is adjustable only in increments of one inch, or whatever the selected space between the slots, as made by the manufacturer. It is therefore impossible to achieve continuous adjustment to exactly fit a wearer, and additionally it is impossible to make any adjustments in the fit while being worn. The holster must be removed, unlaced, adjusted to a new incremental position, relaced, and then replaced.

Although holsters of the type just described have been around for many years, no one has recognized the two serious deficiencies, and the detectives have become accustomed to expecting the unwanted bulges, and the limited and time consuming adjustability.

BRIEF STATEMENT OF THE INVENTION

I have recognized the problem described above and have developed an improved shoulder strap arrangement in which the third piece, the lacing or the flat strap is totally eliminated, and the holster is made fully and precisely adjustable actually while the holster is being worn. I have minimized the thickness to two thicknesses of leather and additionally have reduced significantly the amount of leather and thus the weight of the holster, and have eliminated the unwanted bulge. The foregoing has been accomplished by employing slots in only one of the two members, the holster support portion or the shoulder strap, and the unslotted member, sufficiently narrow to pass through the slots in the other member in a serpentine path. An end tab at each end of the narrow member provides a place for grasping the strap and making the adjustment.

Since the shoulder strap characteristically is made of thinner leather than the holster body, it is preferred that the transverse slot be located in the support section of the holster body and the shoulder strap have a narrowed end engagement region.

Preferably the shoulder strap width in the region where it joins the holster support portion approximates the width of the slots whereby edge friction is present as well as the planar surface frictional engagement.

BRIEF DESCRIPTION OF THE DRAWINGS

This invention may be more clearly understood by the following detailed description and by reference to the drawings in which.

DETAILED DESCRIPTION OF THE INVENTION

Figure 1:
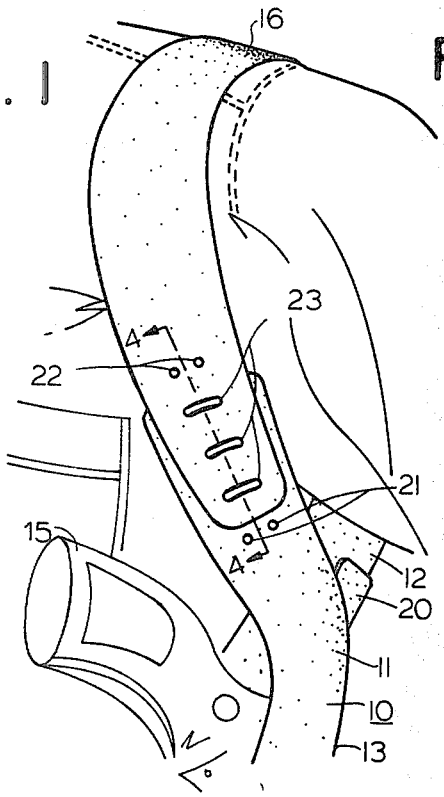
Prior Art FIG. 1
FIG. 1 is a perspective view of a wearer employing a prior art holster of the shoelace type.
Figure 2:
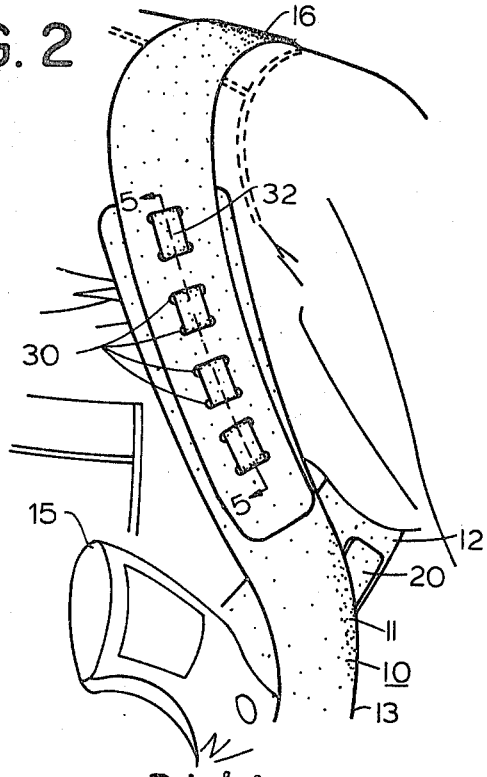
Prior Art FIG. 2
FIG. 2 is a perspective view of a wearer employing the interlaced strap type of prior art.

Now referring specifically to FIGS. 1 and 2 of the drawing which represent two types of prior art for under-arm holsters. Holsters of this type characteristically include a holster body 10 having a pair of upwardly extending support portions 11 and 12 which are usually part of a single piece of leather having a fold 13 at the rear, and an opening 14 at the front through which the hand gun 15 is removed in a cross-draw manner. Often the lower portion of the holster is secured to the wearer's belt by a strap unshown in the drawing, to provide rigidity against which the weapon is drawn. Primary support for the holster comes from a shoulder strap 16, which extends over the near shoulder of the wearer. Secondary support comes from an elastic strap 20, a portion of which appears adjacent to the intersection of the two support portions 11 and 12. The elastic strap 20 which is more clearly shown in FIG. 7 traverses the rear of the wearer, encircles the opposite shoulder from the rear to the front, and returns to join the shoulder strap at the rear in a manner unshown in FIGS. 1 and 2. Holsters of the type shown often are used to carry large handguns such as large frame 44's or Colt 45 automatic weapons. These weapons may be concealed by law enforcement officers when worn with a holster of this type since they extend along the side of the wearer, inside his coat, and under his arm.

The shoulder strap 16 must be joined to the holster support portions 11 and 12, and it is usually undesirable to have the juncture between the two adjustable one way or another to accommodate the differences in the size of the wearer, and to provide greater comfort and security for the wearer. Adjustability and joining of the shoulder strap 16 to the holster extensions 11 and 12 has been accomplished in two basic manners. The first, known as the shoestring approach, involves a series of evenly spaced holes 21 in the support members 11 and 12, and matching holes 22 in the shoulder strap 16. The shoulder strap 16 and the holster body 10 are positioned with the holes in alignment and lace 23 is laced through the two superimposed layers, namely the holster support section 11 and the front ends of the shoulder strap 16. Similarly matching holes and a lace are used to secure the support portion 12 and the rear of the shoulder strap 16. A limited degree of adjustment is possible in this type of shoulder harness to two or three positions, each differing by approximately one inch. Adjustment must be accomplished with the holster removed.

Figure 5:
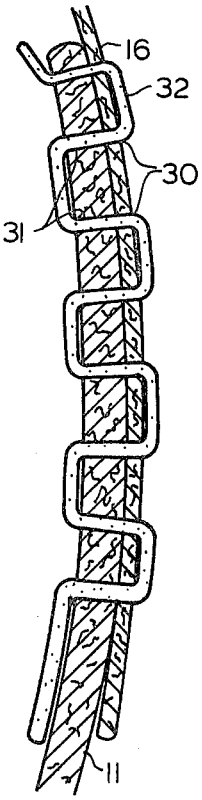
Prior Art FIG. 5

Now referring to FIG. 2, a similar prior art underarm holster is shown which is identical in all respects to that of FIG. 1 with the exception that instead of a plurality of sets of holes such as holes 21 and 22, and straps 23 of FIG. 1, a plurality of slots 30 are present in the shoulder strap 16 and a matching set of slots 31 appearing only in FIG. 5, are present in the support member 11. Instead of lace 23 of FIG. 1, a flat strap 32 is interwoven in a serpentine path through the two sets of aligned slots, those of support member 11 and on the shoulder strap 16. The ends of the straps 32 terminate beneath the support member 11 next to the body of the wearer.

Figure 3:
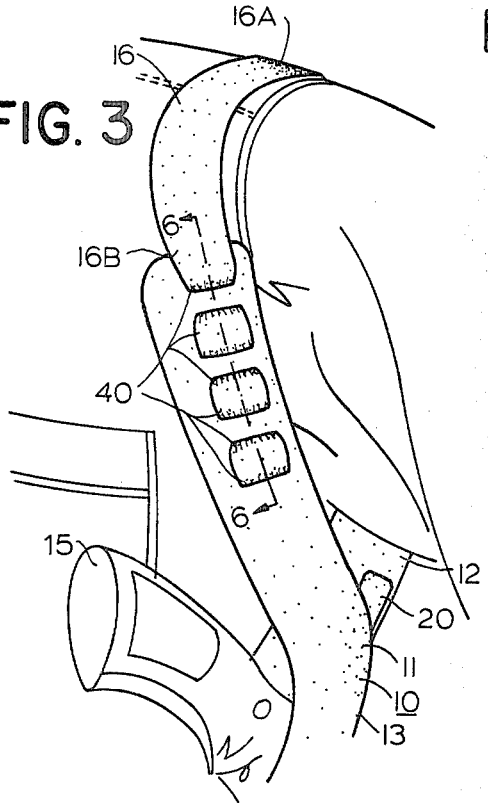
FIG. 3 is a perspective view of a wearer employing this new invention.

Now refer to FIG. 3 disclosing my invention, which employs a holster body 10 and has support portions 11 and 12 which are identical to those of FIG. 2, namely having a plurality of transverse slots 40, in this case located in the support member 11. For example, seven slots, 40 are employed. These slots have a transverse dimension or length of approximately one inch and a gap width of approximately 3/16 inch in normal holsters. The shoulder strap 16 includes an upper shoulder support portion 16*a* which may be as broad or narrow as desired in order to provide adequate support and spreading of the weight across the wearer's shoulder. In preferred form, the upper portion at 16*a* is in the order of two inches wide but the lower portion 16*b* narrows to a width approximating the transverse dimension of the slots 40. The narrow portion 16*b* is laced through the slots 40 in a serpentine path with the end of 16*b*, unshown, located against the inner face of the support member 11. The opposite end of the shoulder strap 16 is likewise narrow and it engages similar slots 52, unshown in FIG. 3 but appearing in FIGS. 7 and 8, in the support portion 12 in the same manner as the front. In such case, the opposite end at the rear of the wearer is likewise located adjacent to the inner side of the support member 12.

As may be apparent in FIG. 3, the end portion 16*b* approximates in width the slots such that a degree of edge friction occurs as each serpentine portion of the shoulder strap 16*b* passes through the support member 12. This edge frictional engagement is in addition to the planar surface friction between the underside of the shoulder strap section 16*b*, and the outer surface of support member 11, and the inner surface of support member 11 and the outer surface of the strap 16.

The rear attachment between the shoulder strap 16 and the holster support portion 12 is virtually identical with that of the front portion including comparable slots to those of slots 40 and the narrow end region. Thus, adjustability is available both at the front and the rear.

Figure 4:
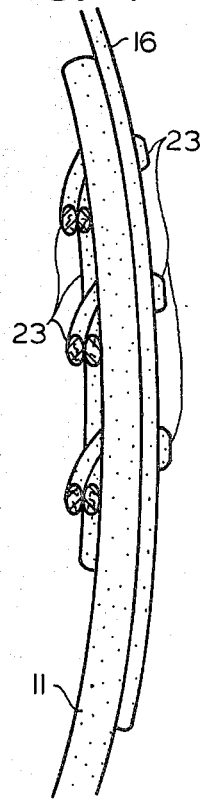
Prior Art FIG. 4
FIGS. 4, 5 and 6 are vertical sectional views through the assembly region of the holsters of FIGS. 1, 2 and 3.
Figure 6:
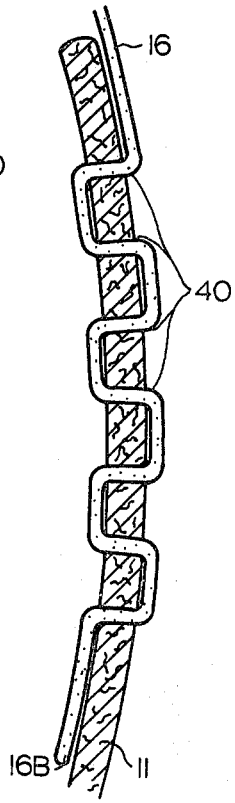

A principal advantage of this invention is apparent by comparison with FIGS. 4, 5 and 6 which show respectively cross sections taken along lines 4—4 of FIG. 1, along lines 5—5 of FIG. 2, and along lines 6—6 of FIG. 3. In each case the holster support member 11 is shown. In the case of FIG. 4, it includes the holes 21, which are unshown in FIG. 4. The cross laces 23 on the outer face of the shoulder strap 16 appear in FIG. 4 as well as their continuation on the underside including the cross-over portions. Depending on the lacing arrangement used, there are at least four thicknesses of leather including the lace 23, and in the lacing arrangement which is commonly used as shown in FIG. 4, there are five thicknesses of leather. The cross-over points where the two portions of the lace 23 form an "X" on the underside, presents a high point which is in contact with the wearer and can be uncomfortable for the wearer when the holster is worn for a long time.

FIG. 5 similarly showing the holster body 11 and the shoulder strap 16 employs the serpentine lace or strap 32. This strap 32 passes through aligned holes 30 in shoulder strap 16 and matching holes 31 in the holster support portion 11. In this case, the thickness of the junction region between the shoulder strap 16 and the holster support portion 11 is at least three thicknesses of leather, and from a practical standpoint is equal to four thicknesses of leather. In both cases as represented in FIGS. 1 and 2 and in FIGS. 4 and 5, it is apparent that the adjustment is limited to the incremental distances between the succeeding sets of holes 21 in FIG. 1 and the succeeding sets of slots 30 in FIGS. 2 and 5.

Now referring to FIG. 6, it may be seen that the plurality of slots 40 extends through the holster body 11 and that the shoulder strap itself is interlaced through the openings 40 beginning at the outside at the upper region and ending at the inside of the holster body support portion 11 at ends 16*b*. The end 16*b* may be used while the holster is being worn to tighten the holster on the wearer or by grasping the shoulder holster by the shoulder strap while holding the holster body, the strap may be lengthened. This is accomplished by longitudinal movement of the strap 16 through the serpentine path. This can be accomplished while being worn, but only with a significant application of force which overcomes the surface friction between the outer and inner surface of the shoulder strap 16 where it is in planar contact with the respective inner or outer surface of the support portion 11 and the slot friction as well. The wearer can be assured that once adjusted in any normal wearing or strenuous activity, the shoulder strap will remain in fixed length and the holster securely in place. The rear portion of the junction between the shoulder strap 16 and the holster support portion 12 is a mirror image of FIG. 6 thereby allowing adjustment both front and rear.

Figure 7:
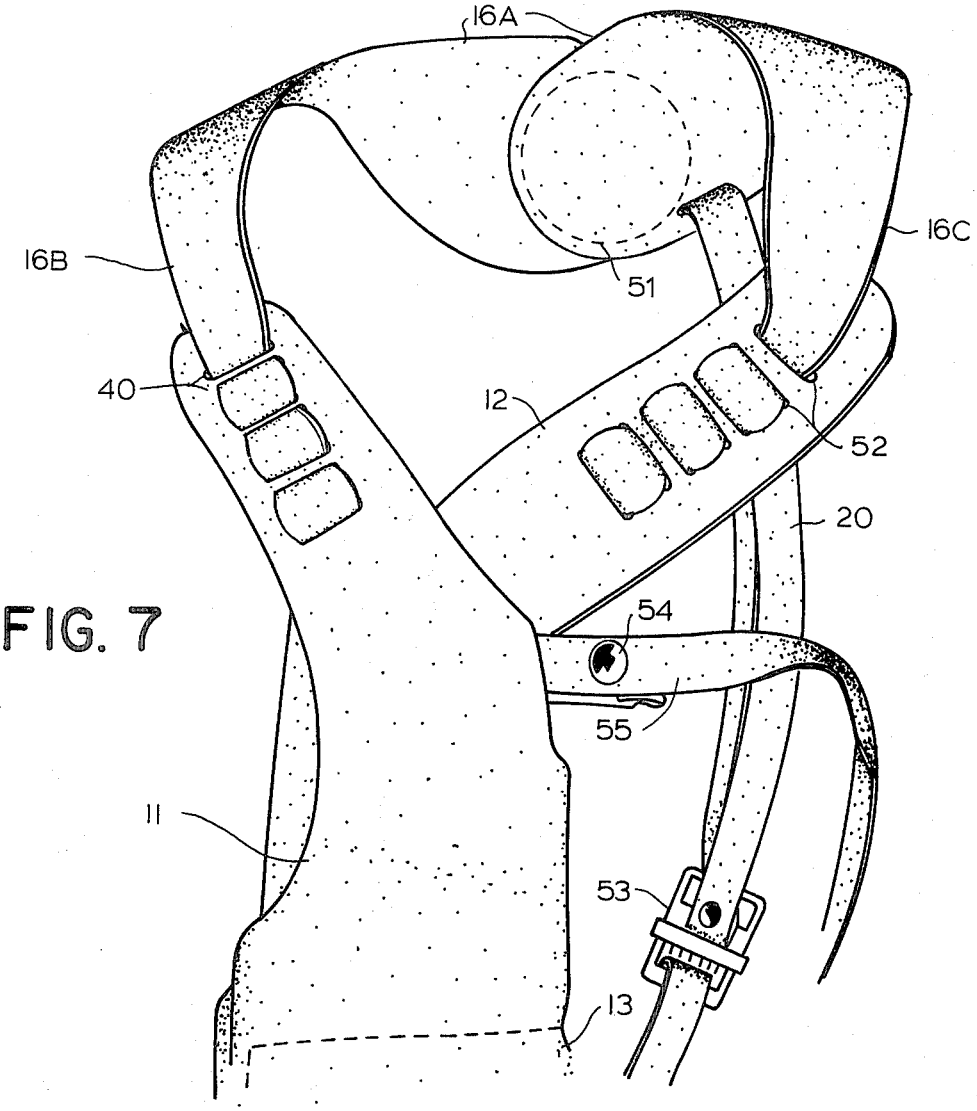
FIG. 7 is an enlarged fragmentary view of the assembly region of this invention.

The full interrelationship between the shoulder strap 16 and the holster 10 is more apparent in FIG. 7 showing the holster assembly and its removed form ready for wearing by a detective. In FIG. 7, the strap 16 may be seen as in actuality, two strap members which are sewn together by a circular stitch line 51. The narrowing portion 16*b* and its interrelationship with the slots 40 is likewise apparent in FIG. 7. The comparable set of slots 52 in the holster support member 12 are apparent and the interrelationship between the narrowing sections 16*c* and those slots 52 of the support portion 12 is likewise visible. The elastic strap member 20 is likewise apparent in FIG. 7. It includes an adjustable fastener 53 which is used to increase or decrease the length of the flexible strap 20. A snap fastener 54 forms an end loop 55 which engages a slot in the holster support portion 12 unshown in FIG. 7 but apparent in FIG. 8.

Figure 8:
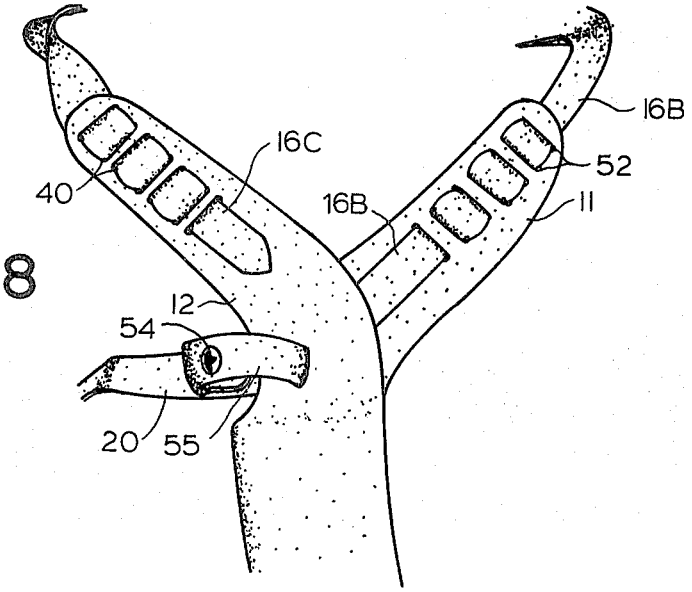
FIG. 8 is a fragmentary rear view of FIG. 7.

Now referring specifically to FIG. 8, the ends 16*b* and 16*c* of the strap 16 are apparent when the holster is viewed from the underside as in FIG. 8. These are the ends which are used for adjustment. It is also apparent in FIG. 8 that the edge friction arrangement between the shoulder strap and the slots 40 and 52 respectively results in slight distortion of the strap end **16*b*** insuring secure support for the holster.

Reviewing this invention, it should be noted that by substituting this form of shoulder strap attachment for the prior art, all of the following are accomplished:

1. A thinner profile is achieved;
2. Infinite adjustment of positioning is achieved;
3. Adjustment may be made while the holster is being worn;
4. Less total leather is required for the holster. One less piece and a narrower shoulder strap is used;
5. Factory assembly is simplified.

Seldom do so many advantages occur while simplifying a product.

The above described embodiments of this invention are merely descriptive of its principles and are not to be considered limiting. The scope of this invention instead shall be determined from the scope of the following claims, including their equivalents.

What is claimed is:

1. An underarm holster and harness comprising:

a holster body having a pair of holster support portions joined to said holster body and extending upward at generally an acute angle whereby one of said pair of holster support portions can extend partially from the underarm region toward the wearer's chest and the other of said pair of holster support portions can extend from the underarm region toward the wearer's back;

a harness comprising an over the shoulder strap including opposite end regions engaging a respective holster support portion of said holster body to define an engagement region between said harness and said holster support portions;

said engagement region defining a plurality of longitudinally spaced transverse slots and an end region interwoven in a serpentine path through said slots;

said end region having smooth edges and sufficient width to maintain continuous frictional engagement with the ends of said slots in addition to the surface friction between the harness and holster support portion defining said engagement region thereby adding sufficient additional frictional resistance to holster movement to support said holster and a weapon therein despite physical exertion of the wearer; and said shoulder strap and holster support portions being continuously adjustable at the engagement portion by manually applied longitudinal force applied thereto.

2. The underarm holster and harness in accordance with claim 1 wherein at least one of said holster support portions contain slots and said shoulder strap has width in the said engagement region greater than the length of said slots.

3. The underarm holster and harness in accordance with claim 1 wherein both said holster support portions include transverse slots and each of the end regions of said shoulder strap engages a respective set of slots of said holster support portions.

4. The underarm holster and harness in accordance with claim 1 wherein the width of said end region is sufficient that it is edge distorted as it passes through each transverse slot by reason of the edge frictional contact between the edges of said strap ends and the ends of said slots.

* * * * *